US007007637B2

(12) United States Patent
Hwang

(10) Patent No.: US 7,007,637 B2
(45) Date of Patent: Mar. 7, 2006

(54) WATER JACKET FOR CYLINDER HEAD

(75) Inventor: Gyu-Han Hwang, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 67 days.

(21) Appl. No.: 10/678,497

(22) Filed: Oct. 3, 2003

(65) Prior Publication Data

US 2004/0065276 A1 Apr. 8, 2004

(30) Foreign Application Priority Data

Oct. 4, 2002 (KR) ..... 10-2002-0060649

(51) Int. Cl.
*F02F 1/10* (2006.01)

(52) U.S. Cl. ..... 123/41.72

(58) Field of Classification Search ..... 123/41.82 R, 123/41.28, 193.5, 41.72
See application file for complete search history.

(56) References Cited

U.S. PATENT DOCUMENTS 5,975,033 A * 11/1999 Wada ..... 123/41.82 R
6,827,049 B1 * 12/2004 Oh ..... 123/41.82 R

* cited by examiner

*Primary Examiner*—Henry C. Yuen
*Assistant Examiner*—Hyder Ali
(74) *Attorney, Agent, or Firm*—Morgan Lewis & Brockius LLP

(57) ABSTRACT

A water jacket for a cylinder head is disclosed. The water jacket comprises a coolant flow channel formed between a coolant inlet and a coolant outlet for allowing the coolant to flow in the cylinder head. Coolant flow regulation parts are provided in the coolant flow channel for accomplishing smooth flow of the coolant between exhaust ports corresponding to respective combustion chambers, and a coolant flow distribution part is provided in the coolant flow channel for uniformly distributing flow of the coolant between the exhaust ports corresponding to the respective combustion chambers. According to the present invention, delay of the coolant flowing between the exhaust ports corresponding to the respective combustion chambers is prevented, and thus a cooling efficiency of the cylinder head is improved.

5 Claims, 1 Drawing Sheet

WATER JACKET FOR CYLINDER HEAD

CROSS-REFERENCE TO RELATED APPLICATIONS

This application claims priority of Korean Application No. 2002-60649, filed on Oct. 4, 2002, the disclosure of which is incorporated fully herein by reference.

FIELD OF THE INVENTION

The present invention relates to a water jacket and, more particularly, to a water jacket for a cylinder head.

BACKGROUND OF THE INVENTION

As well known to those skilled in the art, a water jacket is required to be formed in a cylinder head to optimize uniform flow of a coolant in regions of the water jacket corresponding to respective combustion chambers. Especially, it is very important to cool the vicinity of every exhaust port through which a high-temperature exhaust gas is discharged.

SUMMARY OF THE INVENTION

Embodiments of the present invention provide a water jacket for a cylinder head that achieves uniform flow of a coolant in regions of the water jacket corresponding to respective combustion chambers of the cylinder head, and also achieves uniform cooling between exhaust ports corresponding to the respective combustion chambers, thereby improving the cooling efficiency of the cylinder head.

In one preferred embodiment, there is provided a water jacket for a cylinder head which comprises a coolant flow channel formed between a coolant inlet and a coolant outlet for allowing the coolant to flow in the cylinder head. Coolant flow regulation parts are formed in the coolant flow channel for optimizing coolant flow between exhaust ports corresponding to respective combustion chambers, and a coolant flow distribution part is provided in the coolant flow channel for uniformly distributing flow of the coolant between the exhaust ports corresponding to the respective combustion chambers.

Preferably, the coolant flow channel comprises upper coolant flow channels formed above the exhaust ports in the cylinder head. Lower coolant flow channels are formed below the exhaust ports in the cylinder head, and intermediate coolant flow channels are formed between the exhaust ports for connecting the upper coolant flow channels and the lower coolant flow channels, respectively.

Preferably, the coolant flow regulation parts are first section-reduction parts formed at the upstream areas of the lower coolant flow channels from the connections between the lower coolant flow channels and the intermediate coolant flow channels, respectively, for reducing the flow section of the coolant.

Preferably, the coolant flow distribution part is a second section-reduction part formed at the downstream area of one of the upper coolant flow channels from the connection between the upper coolant flow channel and the corresponding intermediate coolant flow channel for reducing the flow section of the coolant.

BRIEF DESCRIPTION OF THE DRAWINGS

The above and other objects, features and other advantages of the present invention will be more clearly understood from the following detailed description taken in conjunction with the accompanying drawing, in which.

DETAILED DESCRIPTION OF THE PREFERRED EMBODIMENTS

Figure 1:
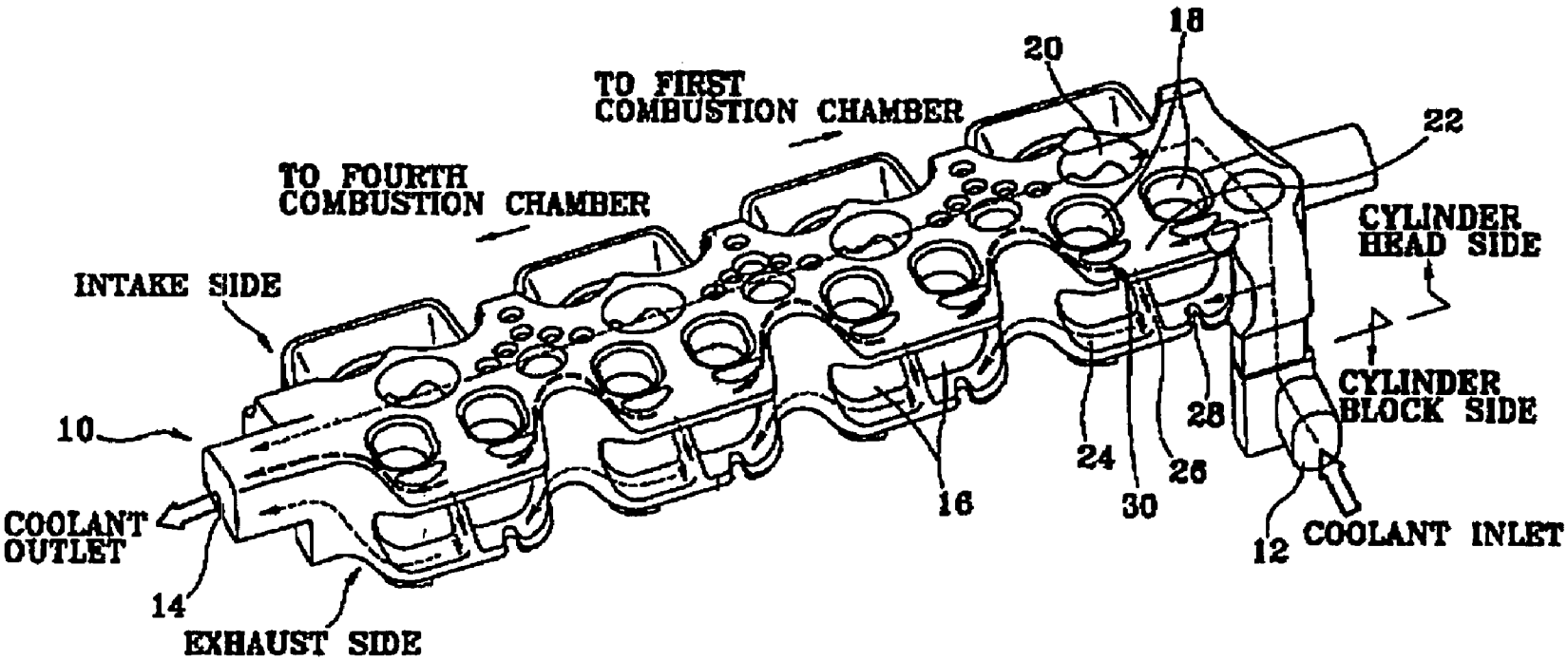
FIG. 1 is a perspective view of a water jacket for a cylinder head according to a preferred embodiment of the present invention.

Referring to FIG. 1, a cylinder head (not shown) of an engine is equipped with a coolant inlet 12 and a coolant outlet 14, through which a coolant flows. A channel having a prescribed volume is formed between the coolant inlet 12 and the coolant outlet 14 for passage of the coolant, which is also called a water jacket 10.

FIG. 1 shows, in three dimensions, the water jacket 10 having a prescribed volume, which is separated from the cylinder head. The coolant is introduced through the coolant inlet 12 from one side of the water jacket 10, and the coolant is discharged through the coolant outlet 14 from the other side of the water jacket 10, which is opposite to the side of the water jacket 10 from which the coolant is introduced.

The water jacket 10 corresponding to every combustion chamber is equipped with a pair of first openings 16, which are provided to form an exhaust port. A pair of second openings 18 are provided to mount an exhaust valve, and a third opening 20 is provided to mount an ignition plug. It should also be noted that the water jacket 10 is equipped with additional openings (not shown), which are provided to mount an intake port and an intake valve.

An upper coolant flow channel 22 and a lower coolant flow channel 24 are formed at the water jacket 10 corresponding to each of the combustion chambers. Specifically, the upper coolant flow channel 22 is formed at the water jacket 10 above the first openings 16, and the lower coolant flow channel 22 is formed at the water jacket 10 below the first openings 16. An intermediate coolant flow channel 26, which is connected between the upper coolant flow channel 22 and the lower coolant flow channel 24, is formed between the first openings 16 in the water jacket 10 corresponding to each of the combustion chambers.

Also, the water jacket 10 is equipped with a coolant flow regulation part for accomplishing smooth flow of the coolant between the first openings 16 in the water jacket 10 corresponding to each of the combustion chambers, and a coolant flow distribution part for uniformly distributing flow of the coolant between the first openings 16 in the water jacket 10 corresponding to each of the combustion chambers so that the flow of the coolant is uniform over all the combustion chambers.

The coolant flow regulation part is a first section-reduction part 28 formed at the upstream area of the lower coolant flow channel 24 from the connection between the lower coolant flow channel 24 and the intermediate coolant flow channel 26 for reducing the flow section of the coolant. The first section-reduction part 28 is provided for every combustion chamber.

The coolant flow distribution part is a second section-reduction part 30 formed at the downstream area of the upper coolant flow channel 22 from the connection between the upper coolant flow channel 22 and the intermediate coolant flow channel 26 for reducing the flow section of the coolant. The second section-reduction part 30 is formed only at the upper coolant flow channel 22 of the water jacket 10 closest to the coolant inlet 12.

Consequently, the coolant introduced into the water jacket 10 through the coolant inlet 12 flows partially along the upper coolant flow channel 22 and partially along the lower coolant flow channel 24. The coolant flowing partially along the upper coolant flow channel 22 flows in regular sequence from the first combustion chamber to the fourth combustion chamber (in case of a 4-cylindered engine), and is then discharged through the coolant outlet 14. Similarly, the coolant flowing partially along the lower coolant flow channel 24 also flows in regular sequence from the first combustion chamber to the fourth combustion chamber, and is then discharged through the coolant outlet 14.

At the lower coolant flow channel 24 located in the downstream area of the first section-reduction part 28, a pressure decrease occurs due to the reduction of the flow section when the coolant flows along the lower coolant flow channel 24. Consequently, the coolant flows from the upper coolant flow channel 22 to the lower coolant flow channel 24 through the intermediate coolant flow channel 26.

In other words, the flow speed of the coolant in the lower coolant flow channel 24 increases immediately after the first section-reduction part 28, and therefore the pressure immediately after the first section-reduction part 28 decreases. As a result, a portion of the coolant flowing along the upper coolant flow channel 22 is guided to the lower coolant flow channel 24 through the intermediate coolant flow channel 26.

Consequently, the coolant flows smoothly from the upper coolant flow channels 22 to the lower coolant flow channels 24 through the intermediate coolant flow channel, whereby the exhaust ports of the cylinder head, through which high-temperature exhaust gases are discharged to the outside, are effectively cooled.

The amount of the coolant passing from the upper coolant flow channels 22 to the lower coolant flow channels 24 through the intermediate coolant flow channel 26 above the first combustion chamber is smaller than that of the coolant passing from the upper coolant flow channels 22 to the lower coolant flow channels 24 through the intermediate coolant flow channel 26 above the second, third, or fourth combustion chamber. This is because the first combustion chamber is closest to the coolant inlet 12, and thus the flow amount of the coolant above the first combustion chamber is larger than that of the coolant above any other combustion chamber.

In other words, the pressure difference between both ends of the intermediate coolant flow channel 26 above the first combustion chamber is reduced by the flow of a large amount of coolant above the first combustion chamber in spite of the pressure decrease caused by the first section-reduction part 28 above the first combustion chamber.

The water jacket of the present invention, therefore, is further provided with the second section-reduction part 30 formed at the downstream area of the upper coolant flow channel 22 from the connection between the upper coolant flow channel 22 and the intermediate coolant flow channel 26 above the first combustion chamber.

The second section-reduction part 30 serves to guide a portion of the coolant flowing along the upper coolant flow channel 22 into the intermediate coolant flow channel 26 above the first combustion chamber. In an exemplary embodiment, the first section-reduction part 28 is restricted by 50–60% relative to the unrestricted part (adjacent), and the second section-reduction part 30 is restricted by 30–40% relative to the unrestricted part (adjacent).

Specifically, a portion of the coolant flowing along the upper coolant flow channel 22 is guided to the lower coolant flow channels 24 through the intermediate coolant flow channel 26 above the first combustion chamber by means of the second section-reduction part 30, and the remaining coolant flows along the upper coolant flow channel 22 via the second section-reduction part 30. As a result, the flow amount of the coolant passing through the intermediate coolant flow channel 26 above the first combustion chamber is sufficient, and thus the flow of the coolant passing through the intermediate coolant flow channels above the respective combustion chambers is uniformly maintained.

As apparent from the above description, the present invention provides a water jacket mounted in a cylinder head, which has a first section-reduction part formed at the upstream area of a lower coolant flow channel from the connection between the lower coolant flow channel and an intermediate coolant flow channel for reducing the flow section of the coolant and a second section-reduction part formed at the downstream area of an upper coolant flow channel from the connection between the upper coolant flow channel and the intermediate coolant flow channel for reducing the flow section of the coolant, whereby the coolant passing along the upper coolant flow channel is partially guided into the intermediate coolant flow channel. The flow amount of the coolant passing through the intermediate coolant flow channels is uniformly distributed over all the combustion chambers and delay of the coolant flowing between exhaust ports corresponding to the respective combustion chambers is prevented. Thus, coolant flow in the cylinder head is optimized.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A water jacket for a cylinder head, comprising:

a coolant flow channel formed between a coolant inlet and a coolant outlet for allowing the coolant to flow in said cylinder head;

coolant flow regulation parts provided in said coolant flow channel for accomplishing smooth flow of the coolant between exhaust ports corresponding to respective combustion chambers; and a coolant flow distribution part provided in said coolant flow channel for uniformly distributing flow of the coolant between said exhaust ports corresponding to the respective combustion chambers, wherein said coolant flow channel comprises:

upper coolant flow channels formed above said exhaust ports in said cylinder head;

lower coolant flow channels formed below said exhaust ports in said cylinder head; and intermediate coolant flow channels formed between said exhaust ports for connecting said upper coolant flow channels and said lower coolant flow channels, respectively.

2. The water jacket as set forth in claim 1, wherein said coolant flow regulation parts are first section-reduction parts formed at the upstream areas of said lower coolant flow channels from the connection between said lower coolant flow channels and said intermediate coolant flow channels, respectively, for reducing the flow section of the coolant.

3. The water jacket as set forth in claim 2, wherein said coolant flow regulation parts are formed in said water jacket corresponding to the respective combustion chambers.

4. The water jacket as set forth in claim 1, wherein said coolant flow distribution part is a second section-reduction part formed at the downstream area of one of said upper coolant flow channels from the connection between said upper coolant flow channel and said corresponding intermediate coolant flow channel for reducing the flow section of the coolant.

5. The water jacket as set forth in claim 4, wherein said coolant flow distribution part is formed at said upper coolant flow channel closest to said coolant inlet.

* * * * *